United States Patent [19]

Rode et al.

[11] 4,108,318

[45] Aug. 22, 1978

[54] APPARATUS FOR OFFSHORE HANDLING AND RUNNING OF A BOP STACK

[75] Inventors: Walter F. Rode, Richardson; Bill R. Jones, Dallas, both of Tex.

[73] Assignee: Sedco, Inc. of Dallas, Texas, Dallas, Tex.

[21] Appl. No.: 477,284

[22] Filed: Jun. 7, 1974

[51] Int. Cl.[2] ..... E21B 3/00

[52] U.S. Cl. ..... 214/1 R; 29/464; 212/3 R

[58] Field of Search ..... 214/1 P, 2.5, 1 PA, 214/12-15 R, 152; 114/0.5 D; 212/3; 29/428, 464, 468, 469; 175/5-10; 61/46.5

[56] References Cited

U.S. PATENT DOCUMENTS 3,661,204 5/1972 Blanding ..... 166/0.5

3,817,412 6/1974 Mercier et al. ..... 214/2.5 X

*Primary Examiner*—Frank E. Werner

*Attorney, Agent, or Firm*—Hubbard, Thurman, Turner, Tucker & Glaser

[57] ABSTRACT

Methods and apparatus for handling a BOP stack on an offshore drilling vessel and for running the stack from the vessel to sea bottom, while maintaining substantially continuous constraint on the stack, are disclosed. Constraining and guide members are provided on the respective sections of the BOP stack and on the drilling vessel for maintaining constraint against substantial lateral movement due to motion of the vessel from the time the BOP stack is picked up from a stored position on the vessel until a substantial portion of the stack is below water during running.

26 Claims, 18 Drawing Figures

APPARATUS FOR OFFSHORE HANDLING AND RUNNING OF A BOP STACK

This invention relates to methods and apparatus for handling and running a BOP stack on a drilling vessel located offshore.

Drilling vessels and other apparatus employed in the drilling of oil wells offshore are generally large and very expensive and their daily operation involves use rates exceeding $20,000 a day in many cases. Thus, it is very important that the drilling operations of such a vessel continue with as little interruption as possible. In the offshore environment, sea and weather conditions are generally the determining factor as to whether or not drilling operations can continue and the equipment utilized is generally designed to permit continuation of operations in as adverse conditions as possible.

At the outset of drilling operations, it is generally necessary to run a blowout preventer (hereafter BOP) stack from the drilling vessel to a sea bottom well head at a depth which may exceed several hundred feet. The BOP stack is generally stored on the vessel as it is moved out to sea, and must be moved from the storage position to a position over the center of the well to be drilled where it is run to sea bottom, generally down through an opening in the vessel (unless drilling is over the side) and along guide lines running from the vessel to a sea bottom well structure. BOP stacks untilized in such cases may weigh in the order of ½ million pounds and be from 25 to 50 feet in height.

Drilling operations in water depths exceeding several hundred feet are generally done from a floating, semisubmersible drilling vessel, or from a drilling ship, which are supported by buoyancy and not on the sea bottom. In the use of drilling vessels of this type, the handling and running of the BOP stacks becomes very difficult and dangerous when sea conditions are such to cause any appreciable roll, pitch, or heave of the drilling vessel. Heretofore, it has not been uncommon for drilling operations to be delayed or interrupted for periods of several days or even several weeks by the necessity of waiting for calmer sea conditions to permit the handling and running of the BOP stack.

In the past attempts have been made to constrain the BOP stack during handling and running by wire lines and a bridge crane. However, during swelling seas the wire line constraints are subject to breakage which can result in damage to the drilling vessel and BOP stack, and serious injury to the vessel personnel. Also, the constraint provided is not continuous as the wire lines must be removed as the BOP stack is lowered from the vessel so that a critical period is provided during lowering of the BOP stack through the vessel, and before it enters the water, when sufficient constraint is not provided.

The problems associated with the handling and running of a BOP stack from an offshore drilling vessel are substantially reduced or eliminated by use of the present invention which provides for adequate constraint and guiding of the BOP at all times from the time that it is picked up from a storage position until it enters the water and is substantially through the splash zone where the most violent wave action occurs, generally from the surface of the water to about 12 – 15 feet below the surface of the water. This invention is particularly applicable to the handling and running of large BOP stacks which are generally stored in multiple sections and present additional problems during handling and running because their height when stacked may exceed the height of the rotary table above the main deck or platform of the vessel. In this case, not only must each section of the stack be constrained during handling, but as one section is being handled, the other must be adequately constrained.

In accordance with this invention, this constraint is provided by providing a guide well including guide members in the main deck for receiving and guiding the BOP stack as it is lowered through the deck, and cooperating guide members or bumpers on the BOP stack for cooperation with the guide members of the guide well as the BOP stack is lowered. Also, if the BOP stack is stored and handled on the drilling vessel in multiple sections, the multiple sections include cooperating guiding and constraining members so that each section is continuously constrained against substantial lateral movement due to motion of the vessel as it is moved from a storage position to the running position, and while the other section or sections are being handled.

In the drawings, wherein a preferred embodiment of the present invention is illustrated and wherein like reference numerals are used throughout to designate like parts:

Figure 1:
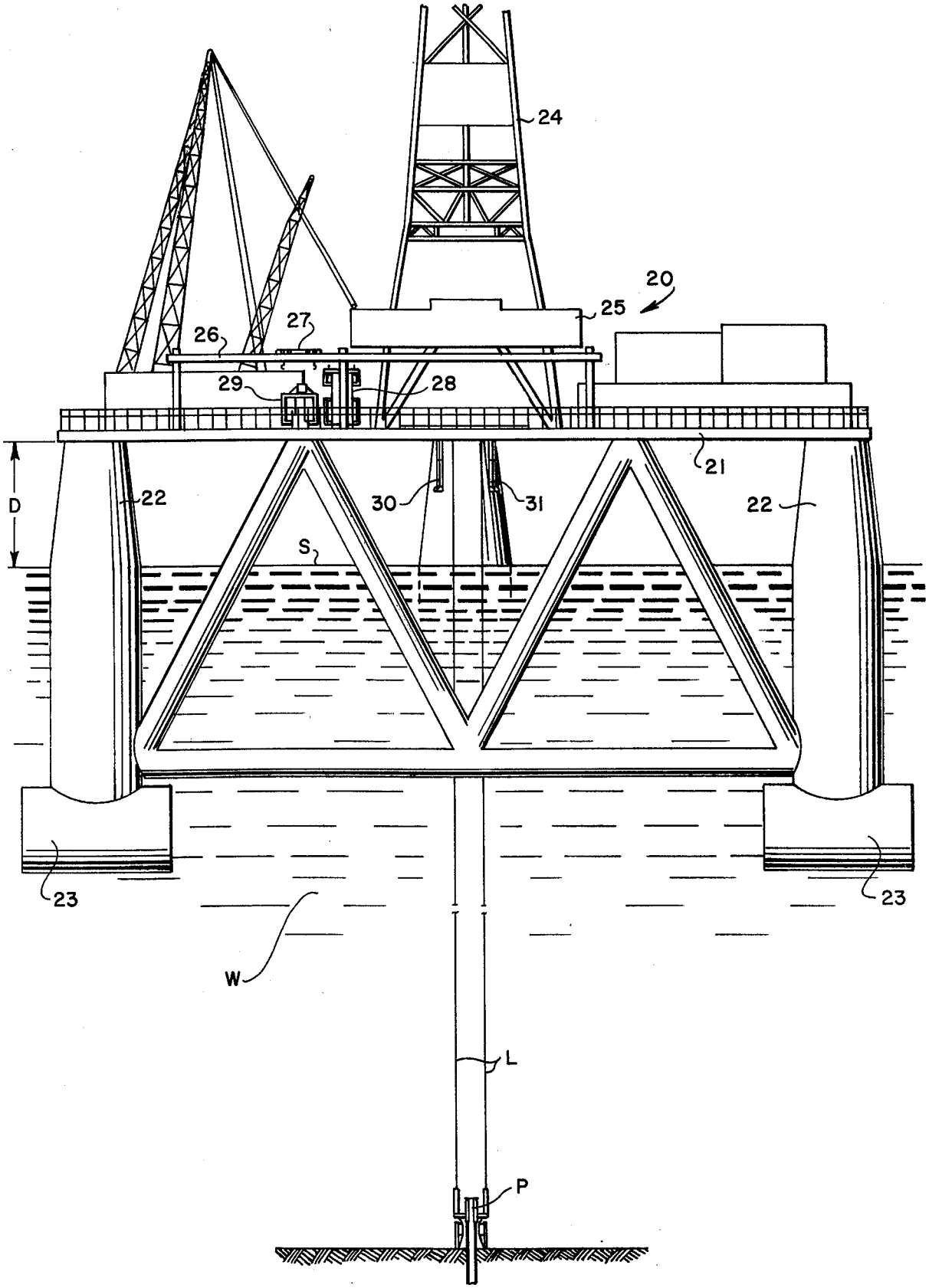
FIG. 1 is a perspective view in elevation of an offshore drilling platform utilizing the present invention to handle and run a BOP stack including a lower section and an upper section.

Referring now to FIG. 1, a semisubmersible offshore drilling vessel 20 is illustrated as including a platform or maind deck 21 supported by spaced stability columns 22 having footings 23 at their lower end, and a drilling derrick 24 mounted on a rotary table 25, as is conventional. Drilling vessel 20 is illustrated in a drilling position in a body of water W and has a draft D between the surface S of the body of water and the lower portion of main deck 21. As is also conventional in drilling vessels such as illustrated, crew quarters and associated drilling equipment may be mounted on main deck 21.

Mounted on main deck 21 below rotary table 25 are tracks 26 on which a bridge crane 27 is mounted for the purpose of transporting the sections of a BOP stack from a storage position to a center of the well position. A BOP stack including a lower section 28 and an upper section 29 is shown as mounted on main deck 21 below tracks 26 in the storage position. Also, an opening 21*a* (see FIG. 6) is provided in main deck 21 through which drilling operations are performed, or the drilling operations may be performed over the side of main deck 21.

In accordance with this invention, a guide well is formed below opening 21*a* in main deck 21 by a plurality of main guide beams or members 30 and 31 which extend below main deck 21 as shown in FIG. 1. The structure and operation of guide members 30 and 31 are described and discussed in detail in the description of FIGS. 5 and 6 to follow.

Figure 2:
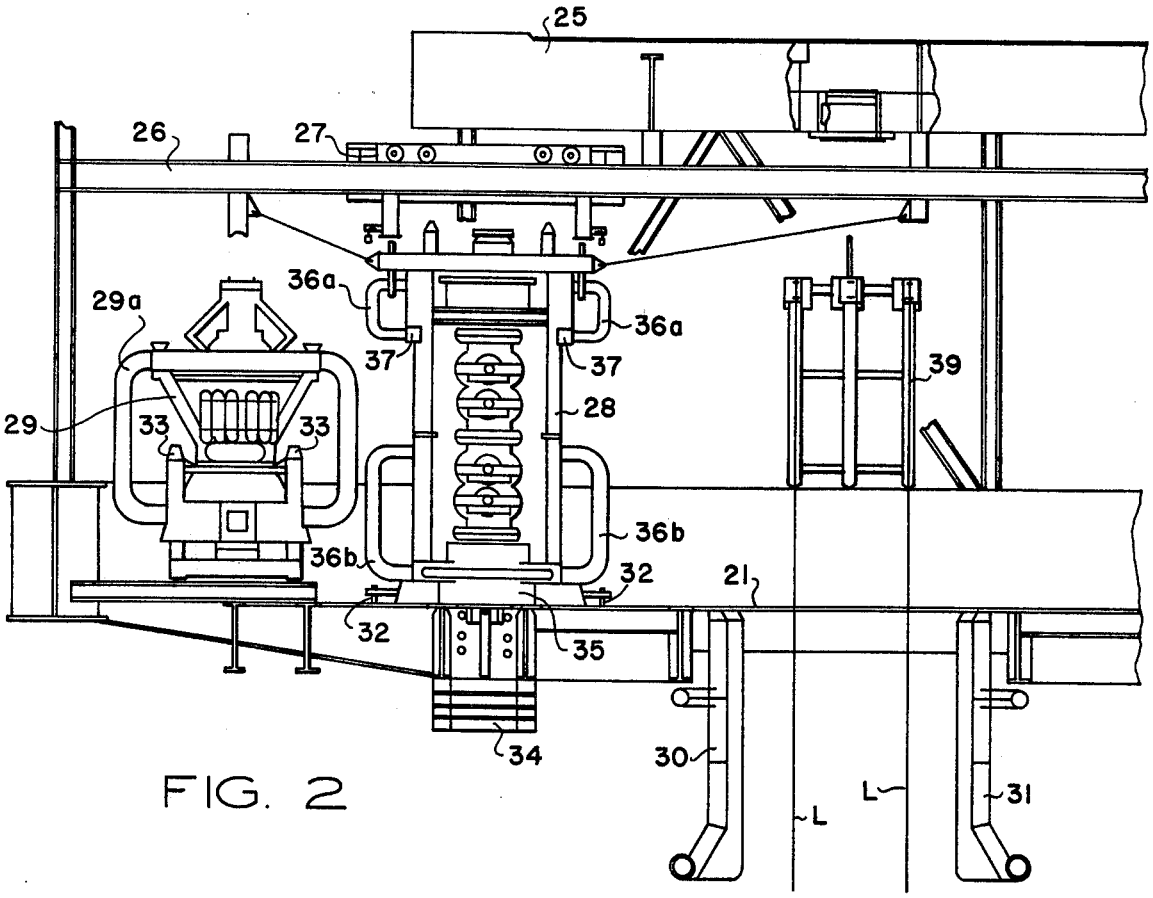
FIGS. 2 – 4 are front views in elevation illustrating various positions of the lower section of a BOP stack as it is moved from a storage position to the center of the well position.

Referring now to FIG. 2, sections 28 and 29 of the BOP stack are illustrated in their stored position on main deck 21, below tracks 26 and bridge crane 27. Lower section 28 of the BOP stack may be secured to main deck 21 by bolts 32 and upper section 29 may be mounted on main deck 21 on guide rods 33 as hereinafter explained in detail. The mounting of each of sections 28 and 29 is such that during the movement of vessel 20 to an offshore location, sections 28 and 29 are rigidly constrained in position.

Figure 5:
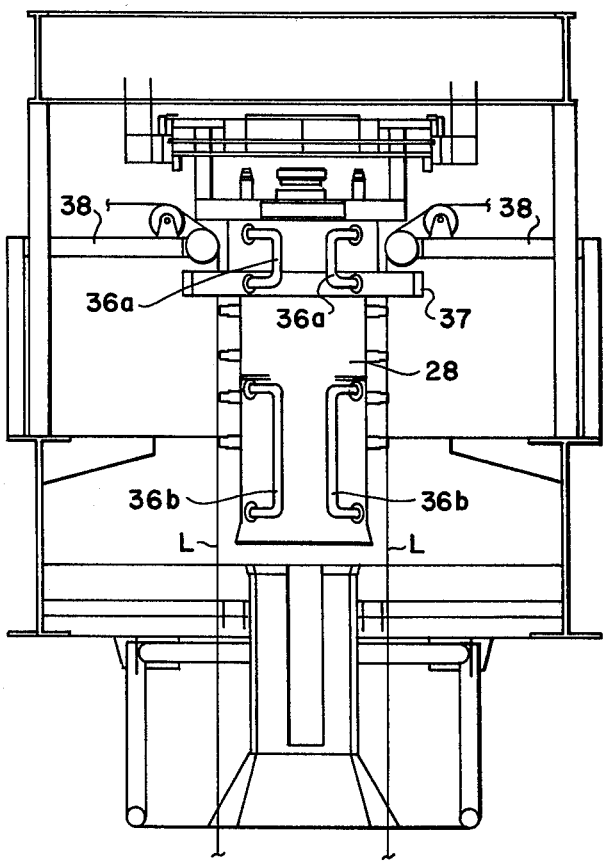
FIG. 5 is a side view in elevation of the apparatus illustrated in FIG. 4.

As illustrated in FIG. 2, lower section 28 of the BOP stack is mounted on main deck 21 over a test stump 34 which is connected to the well head connector 35 of section 28 to permit testing of a BOP stack in the stored position. Also, lower section 28 includes a plurality of guiding members, or bumpers, 36*a* and 36*b* which may be any number greater than two which provides for guidance of lower section 28 in guide members 30 and 31 as hereinafter described. As illustrated in FIGS. 5 and 6, eight such bumpers are utilized in the embodiment illustrated, including one pair of upper bumpers 36*a* on each side of section 28, in the upper portion thereof, and one pair of lower bumpers 36*b*, on opposite sides of section 28 in the lower portion thereof.

Lower section 28 also includes a pair of hanging beams 37 mounted on opposite sides of the lower section, near the top thereof (see FIG. 5), and the lower end of upper bumpers 36*a* are secured to hanging beams 37. Also, slotted receiving and retaining members 38 for receipt of guide lines are provided at opposite corners of lower section 28, as shown in FIG. 6A.

As shown in FIG. 5, each pair of bumpers extend outwardly from section 28 and converge toward the center thereof. Of course, other arrangements, such as single bumpers on each side of lower section 28, could be utilized The size and spacing of the respective bumpers is explained in detail with respect to the operation of this invention in the description of the Figures to follow.

Also, as illustrated in FIGS. 1 and 2, a plurality of guide lines L, for example, four (see FIG. 6), are provided through the guide well and main deck 21, extending from vessel 20 to a subsea structure T illustrated in FIG. 1. Guide lines L function to guide and constrain the BOP stack during the running of the stack from vessel 20 to where they are landed on substructure T. Guide lines L are supported in pairs on each side of the guide well by a movable carriage structure 39 including pulleys 40, and structure 39 functions also to move guide lines L from the position in FIG. 6 where the BOP stack can be placed into the guide well formed about opening 21*a* by guide members 30 and 31, to a position represented by FIG. 6B where the guide lines are in line with guide line receiving members 38 to permit running of the BOP stack down the guide lines. Each of carriage structures 39 can be connected to a hydraulic cylinder (not shown) for causing its movement between the respective positions described.

Figure 6A:
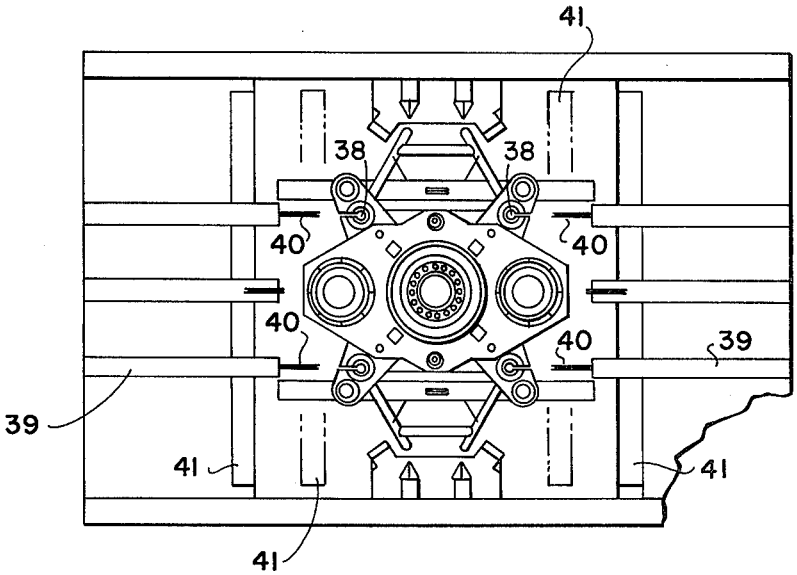
FIG. 6A is a top view in elevation of the apparatus illustrated in FIG. 4.
Figure 6B:
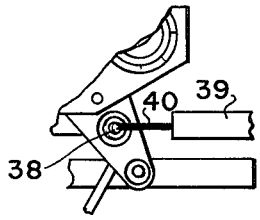
FIG. 6B is an exploded view taken at 6 in FIG. 6A.

Also, as illustrated in FIG. 6, a pair of spider beams 41 are provided on opposite sides of opening 21*a*, just below main deck 21, and spider beams 41 are also connected to an actuating mechanism (not shown) to move them from the solid line position of FIG. 6A, where the BOP stack can be lowered through opening 21*a*, to the dotted line position in FIG. 6A where hanging beams 37 are landed on the spider beams to support lower sections 28 of the BOP stack while upper section 29 is being handled.

When the operation of moving the BOP stack in position for running commences, bridge crane 27 is moved into the position shown in FIG. 2, above lower section 28, and the lift gear 42 of bridge crane 27 (see FIG. 8) is connected to appropriate eye hooks (not shown) on lower section 28 to permit its lifting by bridge crane 27. When section 28 is secured to bridge crane 27, bolts 32 can be released, hold down lines (if any) disconnected, well head connector 35 unlocked, and test stump 34 retracted. Lower section 28 can then be raised as shown in FIG. 3 to where it is snug against bridge crane 27 and restrained thereby.

Figure 3:
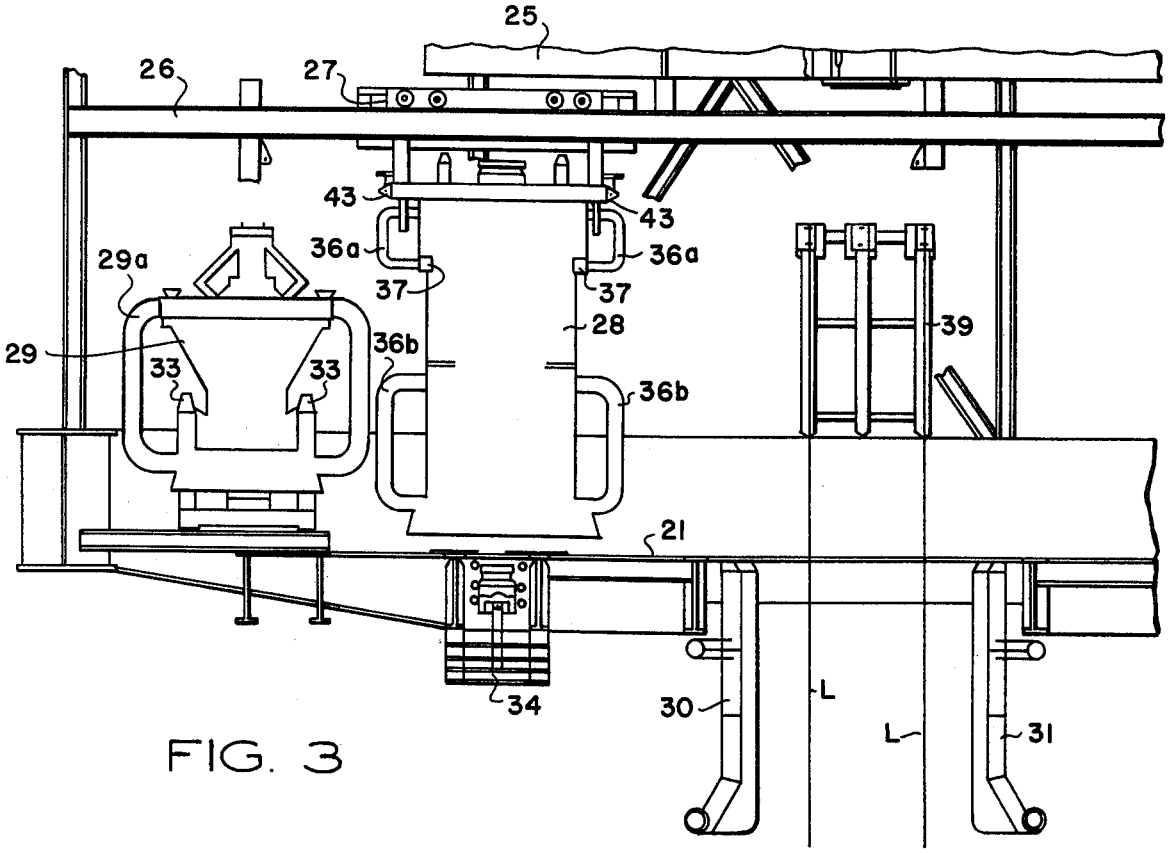
Figure 4:
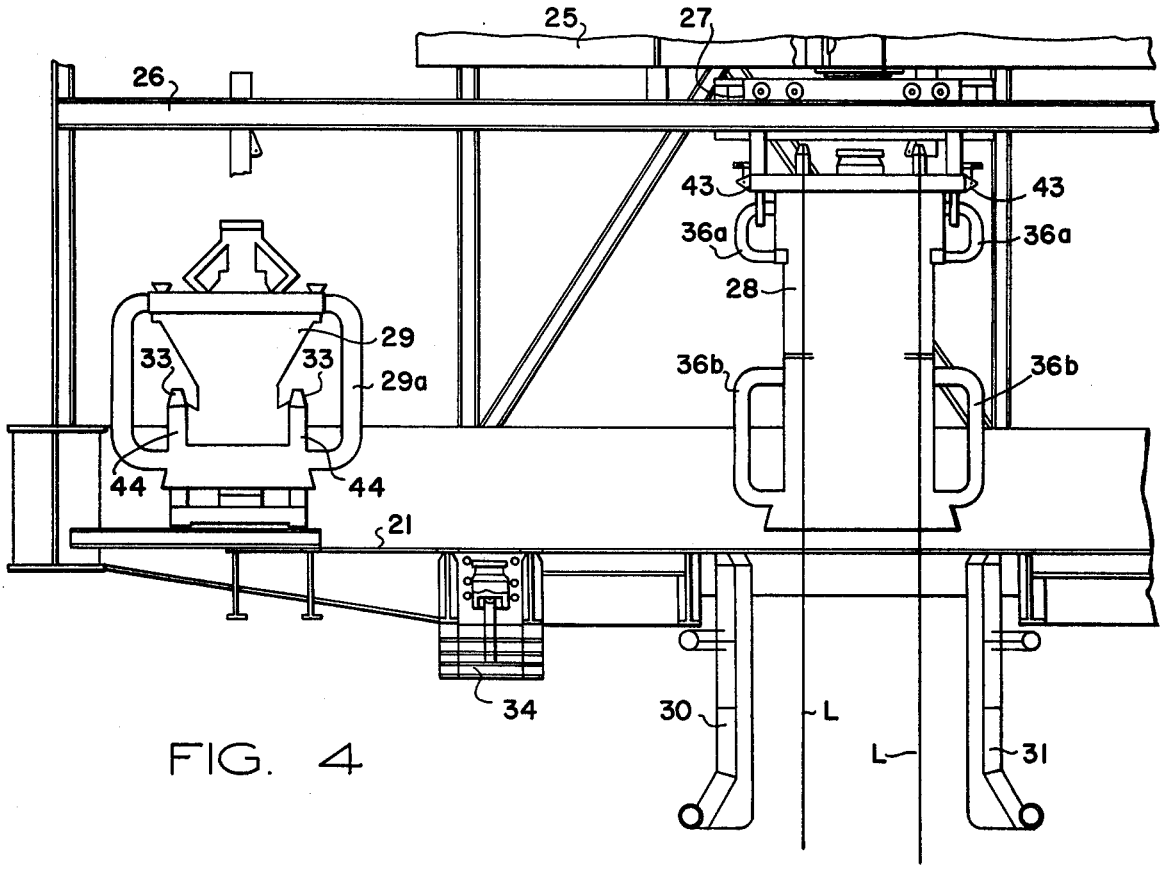
Figure 7:
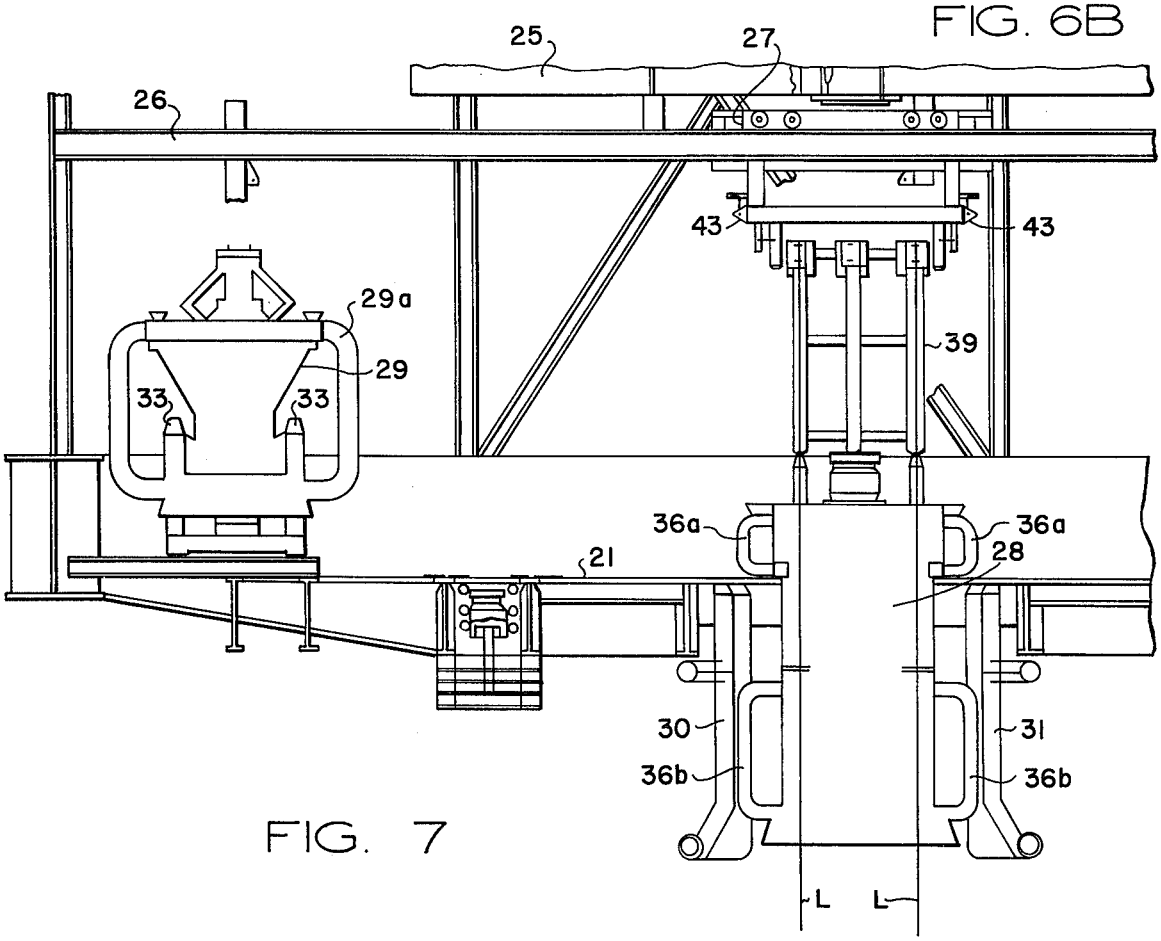
FIG. 7 is a front view in elevation illustrating the lowering of the lower section of the BOP stack into a guide well.

As lower section 28 is snubbed up against bridge crane 27 as illustrated in FIG. 3, it may be pinned in place by locking pins 43 and bridge crane 27 moved from the position of FIG. 3 to the position of FIG. 4 wherein section 28 is located over the guide well formed by guide members 30 and 31. When the position of FIG. 4 is reached, FIG. 5 illustrates the position of section 28 from the side thereof, and FIG. 6 represents the position of section 28 over opening 21*a* from the top thereof. At this position, locking pins 43 are released and lower section 28 of the BOP stack lowered through opening 21*a* and between guide members 30 and 31 so that bumpers 36*a* and 36*b* are in the orientation shown in FIG. 6 with respect to the guide members. At the same time spider beams 1, which had previously been retracted to permit lowering of the BOP stack into the guide well, are moved to the dotted line position of FIG. 6A so that hanging beams 37 can be landed on the spider beams as illustrated in FIG. 7. An important feature of this invention is that as the constraint provided by bridge crane 27 against movement of lower section 28 is lost by the lowering of lower section 28 from the bridge crane, the lower bumpers 36*b* enter in the guide well formed by guide members 30 and 31 to furnish the necessary constraint as the lowering operation continues. Once lower section 28 of the BOP is landed on spider beams 41, the lifting gear 42 of bridge crane 27 can be disconnected and the bridge crane moved back to the position shown in FIG. 8 where it is over upper section 29 of the BOP stack.

As previously noted, upper section 29, which includes bumpers 29*a* positioned and mounted in the same manner as the bumpers on lower section 28, is mounted on main deck 21 on upstanding guide rods 33 which extend from main deck 21. For this purpose guide rods 33 extend into guide tubes 44 provided in upper section 29, and, for example, four such guide rods and tubes may be provided.

Figure 8:
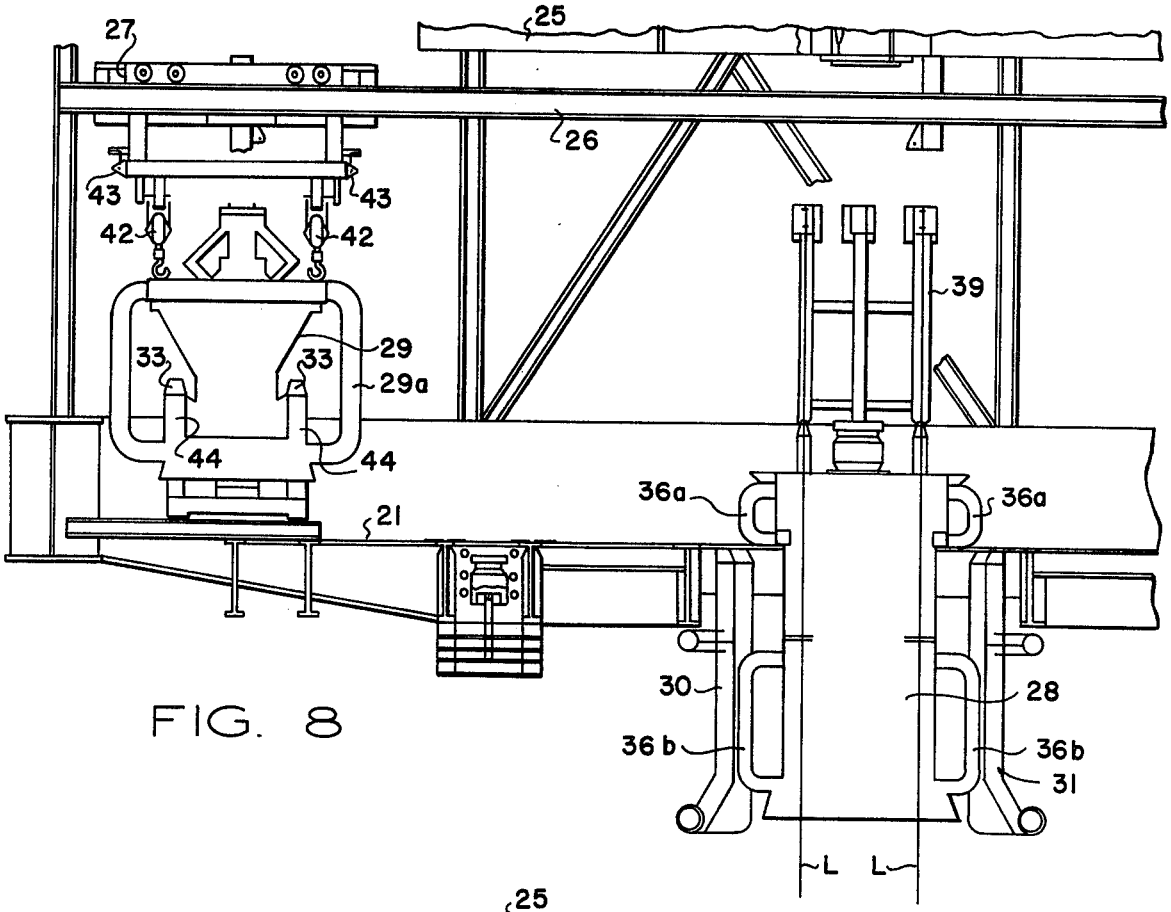
FIGS. 8 – 11 are front views in elevation illustrating various positions of the upper section of the BOP stack as it is moved from a storage position to where it is mounted on the lower section of the BOP stack.
Figure 9:
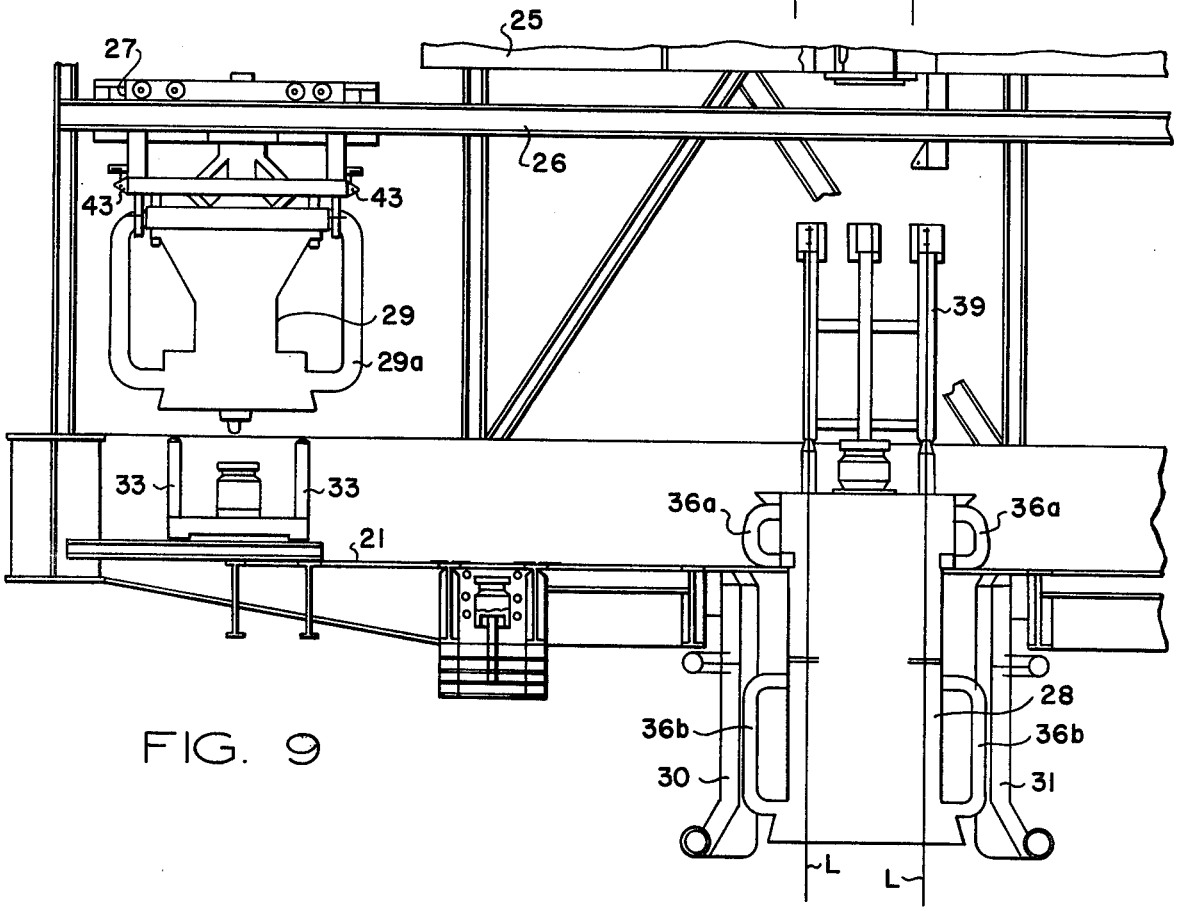

As shown in FIG. 8, during handling of upper section 29, lifting gear 42 of bridge crane 27 is connected by suitable eye hooks to upper section 29, section 29 is then disconnected from its mounting and then lifted by bridge crane 27. As section 29 is lifted by the bridge crane, a further feature of this invention is that it is not until section 29 is substantially snug against and constrained by bridge crane 27 that the guide tubes 44 clear guide rods 33, as shown in FIG. 9. Thus, during the lifting operation of the upper section 29, adequate constraint is provided at substantially all times against all but the upward movement of the upper section.

Figure 10:
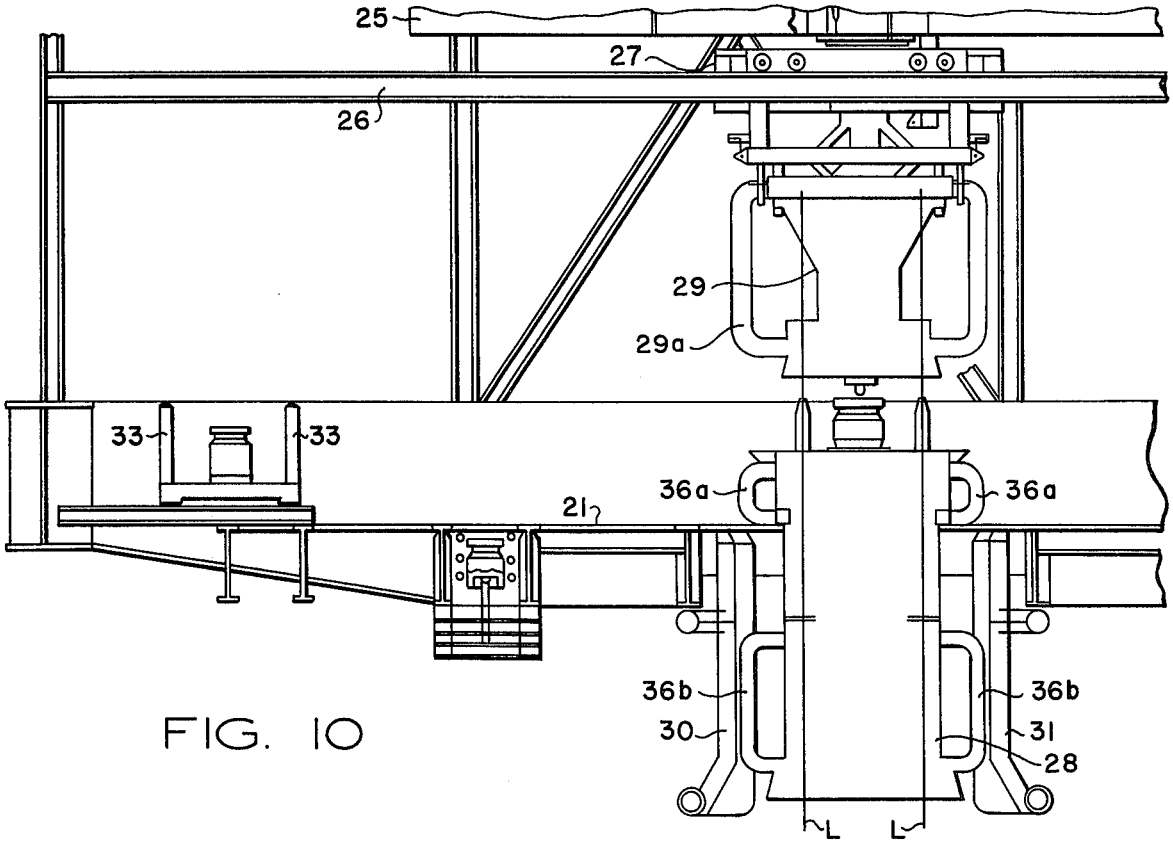

Once the upper section 29 is snugged against bridge crane 27 (such as by over running the lifting hoist of the bridge crane), it is carried by the bridge crane to the position of FIG. 10 over lower section 28 which had previously been moved in position in the guide well formed by guide members 30 and 31. Upper section 29 is then lowered onto the top of lower section 28, and connected thereto. At this time guide lines L are moved in toward the BOP stack by movement of carriage structure 39, and guide lines L are installed into receiving members 38.

Figure 11:
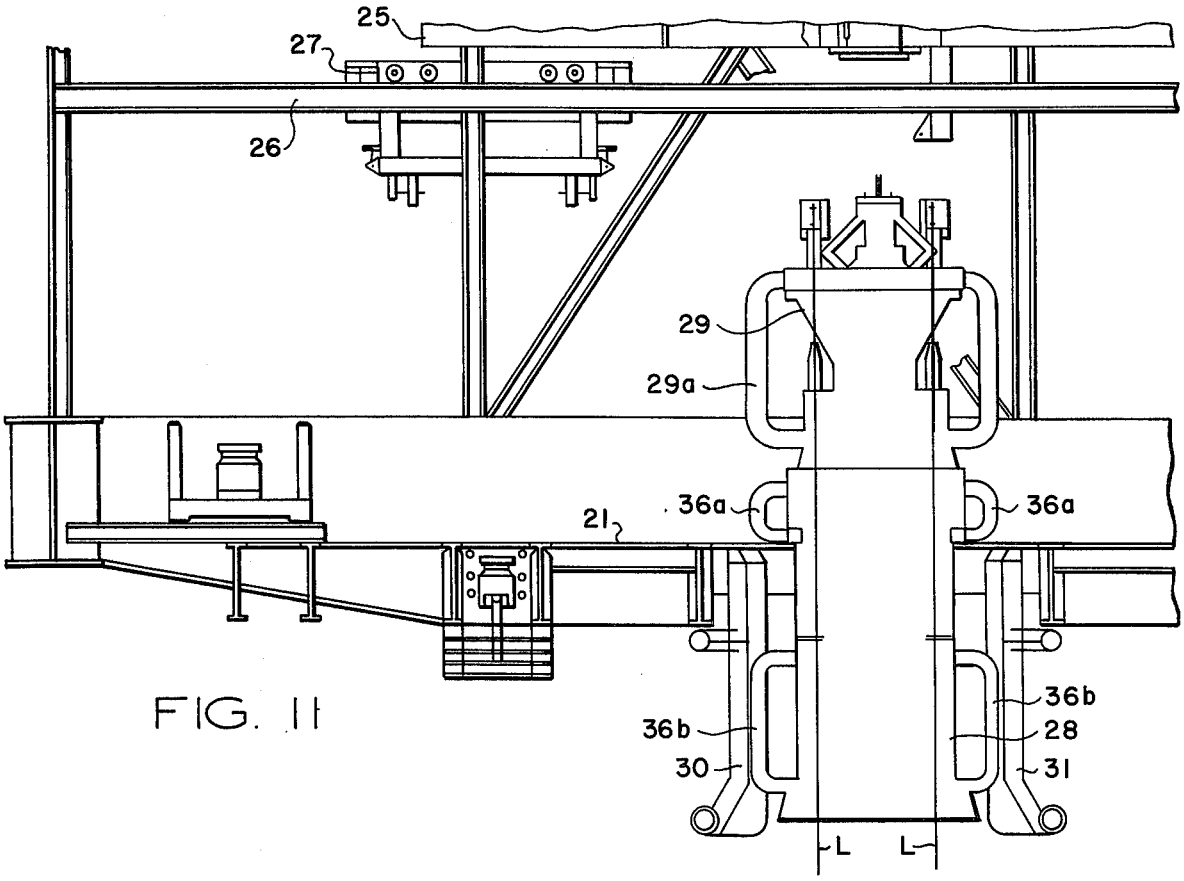
Figure 12:
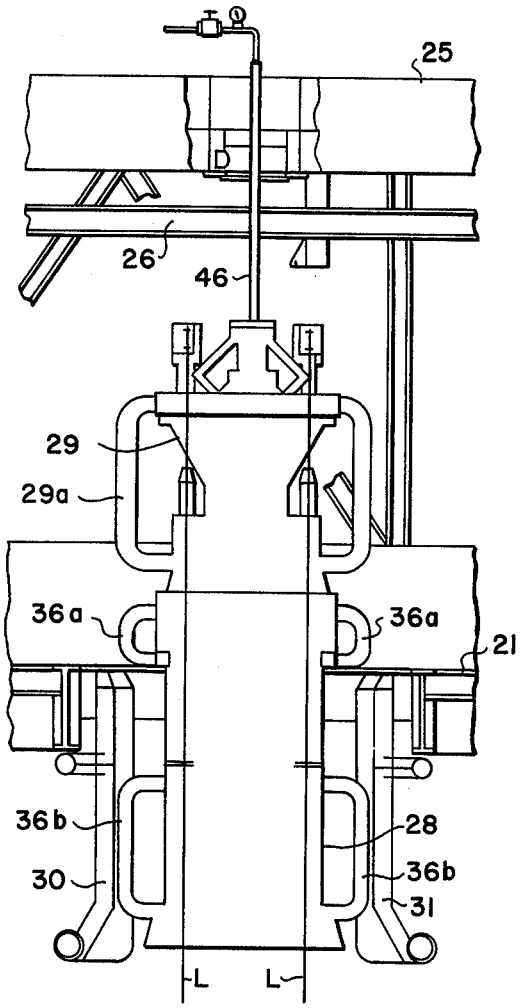
FIG. 12 is a front view in elevation illustrating testing of the completed BOP stack prior to running.

A plurality of extendible guide posts, for example four, are provided on lower section 28 for extending into guide tubes 44 of upper section 29. Guide post 45 may be extended hydraulically, or manually and when extended as illustrated in FIG. 11 extend through guide tubes 44. All internal connections between sections 28 and 29 can be made at this time. As shown in FIG. 12, once these connections are made, the joined BOP stack can be tested through in test apparatus 46, prior to running of the stack to sea bottom.

Figure 13:
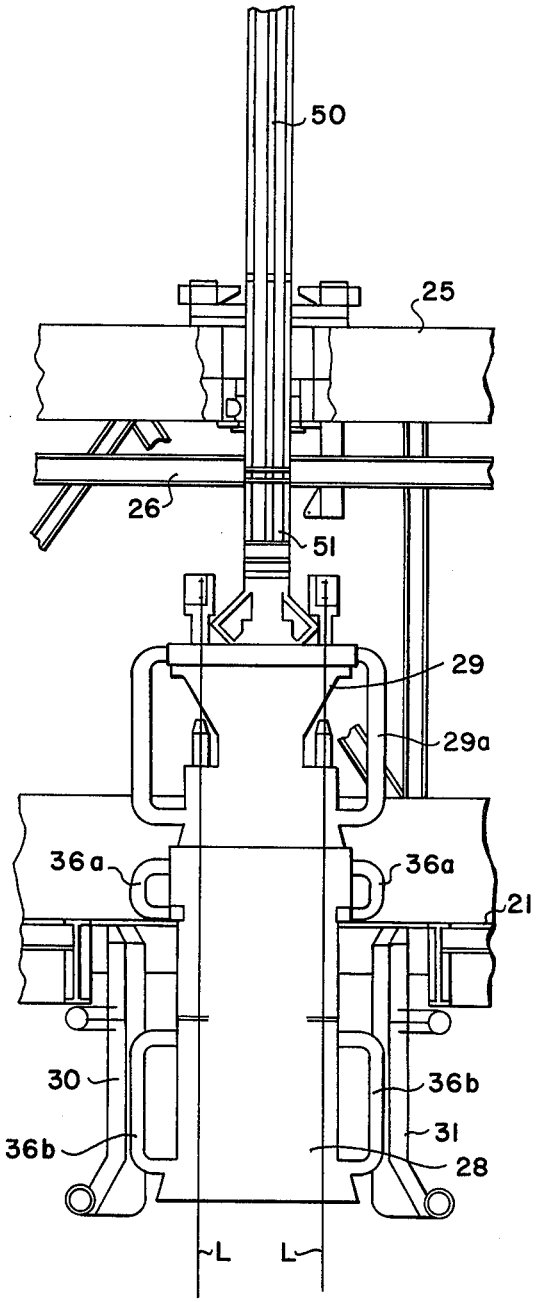
FIG. 13 is a front view in elevation illustrating the connection of the BOP to a running joint of pipe.
Figure 14:
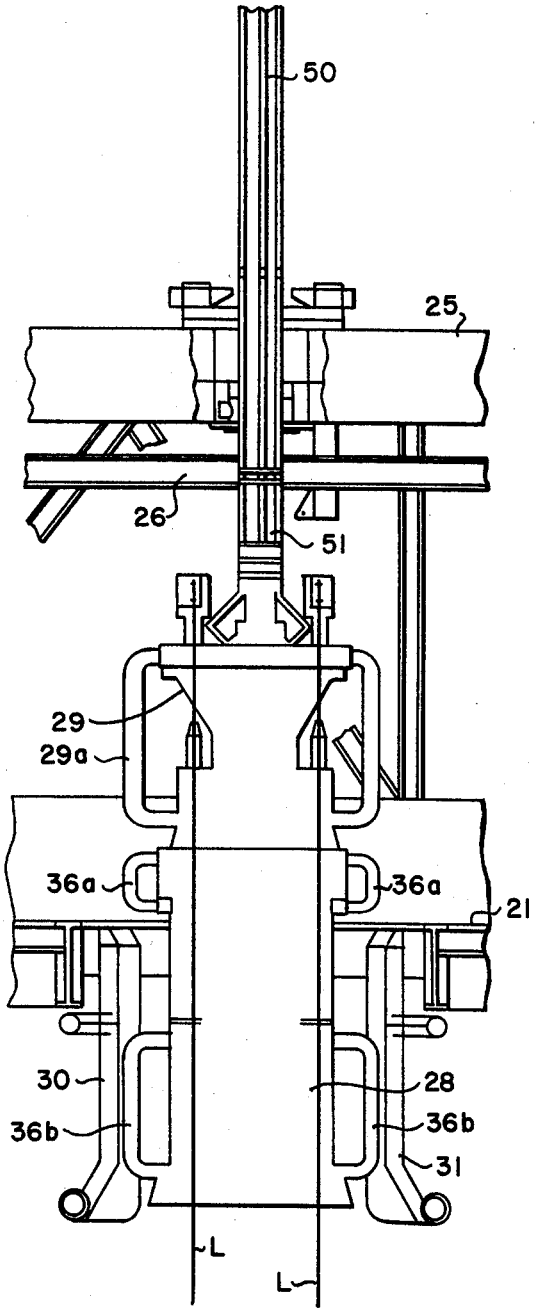
FIGS. 14 – 17 are front views in elevation illustrating the running of the BOP stack from the drilling platform to sea bottom.
Figure 15:
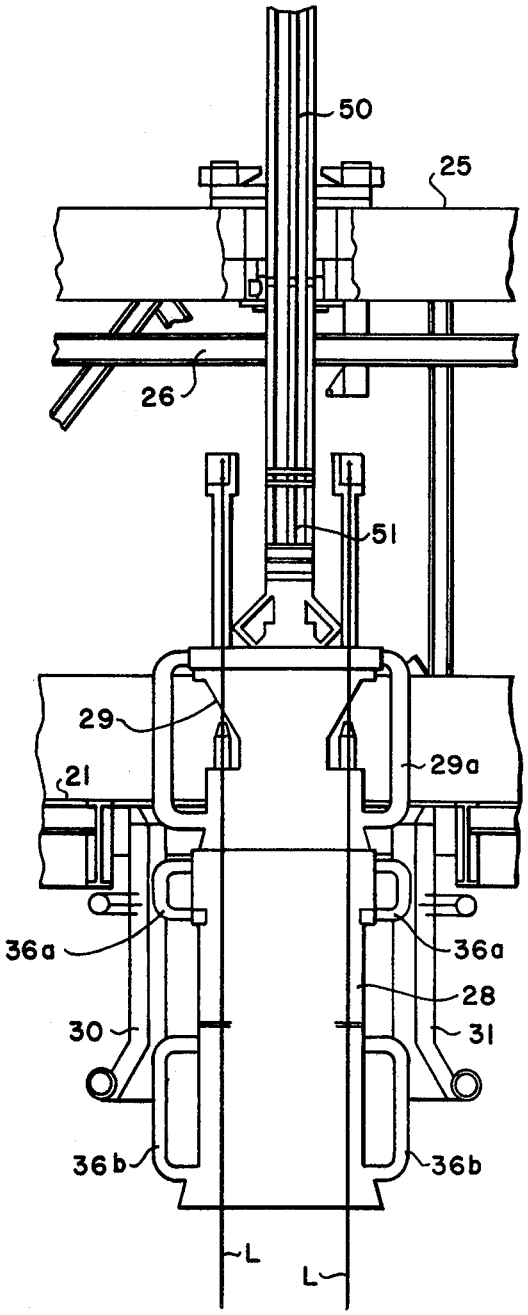

At the start of the running of the BOP stack to sea bottom, the first stand of pipe consisting of a 50′ section 50 (some times referred to as the red joint) and a six foot AMF connector (see FIG. 13) is picked up and lowered through the rotary table and connected into a riser adapter 52 at the top of the BOP stack, and secured thereto. The BOP stack is then picked up, as in FIG. 14, and spider beams 41 retracted so that the BOP stack can be lowered through opening 21*a*. As shown in FIG. 15, during the lowering procedure, the size and spacing of the bumpers on upper and lower sections 28 and 29, and the length of main guides 30 and 31 are such that lower bumpers 36*a* are still in main guides 30 and 31 as bumpers 29*a* of upper section 29 enter the main guides, again ensuring that the BOP stack is under adequate restraint as it is lowered through and between the guide members 30 and 31.

A further consideration in determining the length of guide members 30 and 31 is that it is highly desirable, while vessel 20 is at a normal draft for lowering and running the BOP stack, that upper bumpers 29*a* be between the guide members until at least a substantial portion of the BOP stack is in the sea water and below the splash zone, i.e., from about 12 – 15 feet below the water's surface. Thus, as illustrated in FIG. 15, this condition is provided in the embodiment shown with a draft D of about 44 feet between the surface S and the lower portion of deck 21, with the main guide beams being about 20 feet in length, and the overall height of the BOP stack being about 42 feet. In this case just as upper bumper 29*a* is leaving main guide beams 30 and 31, the lower end of the BOP stack is the distance R below the surface S, in this case about 14 feet.

Figure 16:
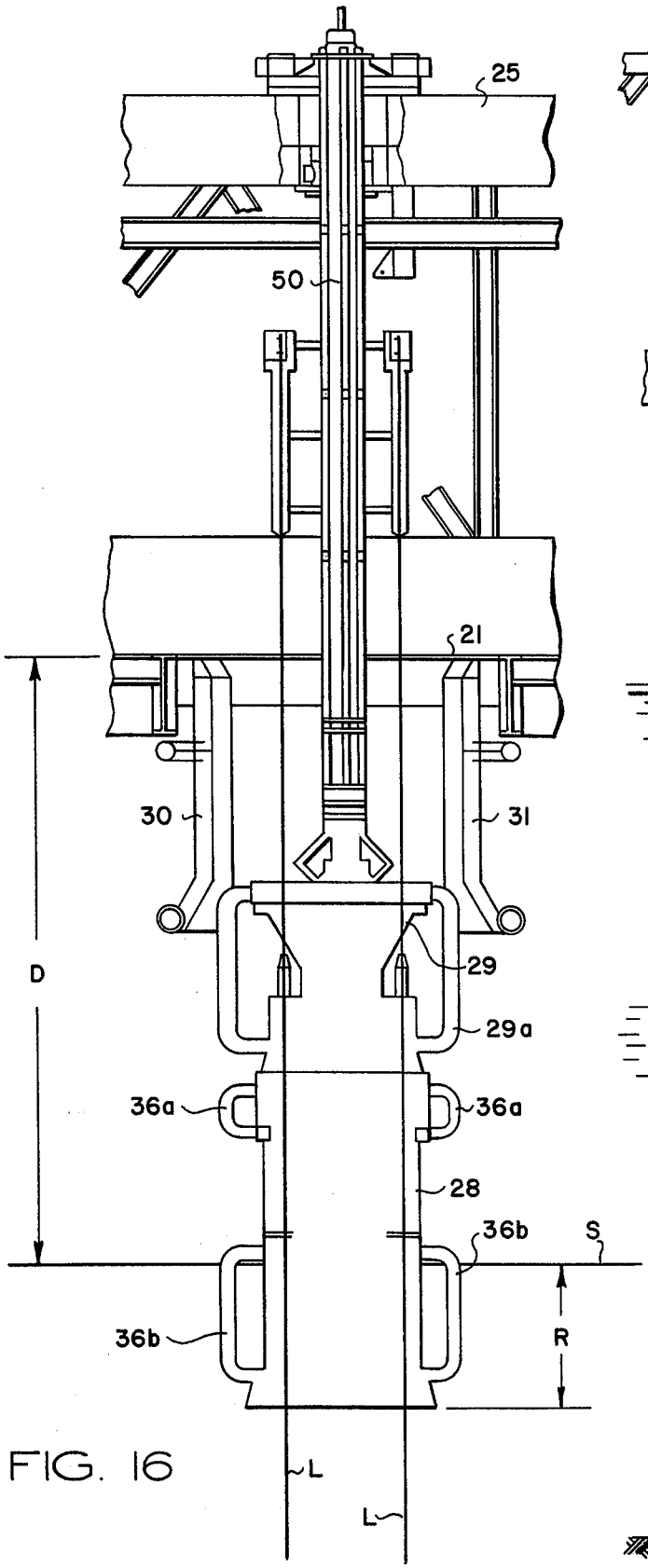
Figure 17:
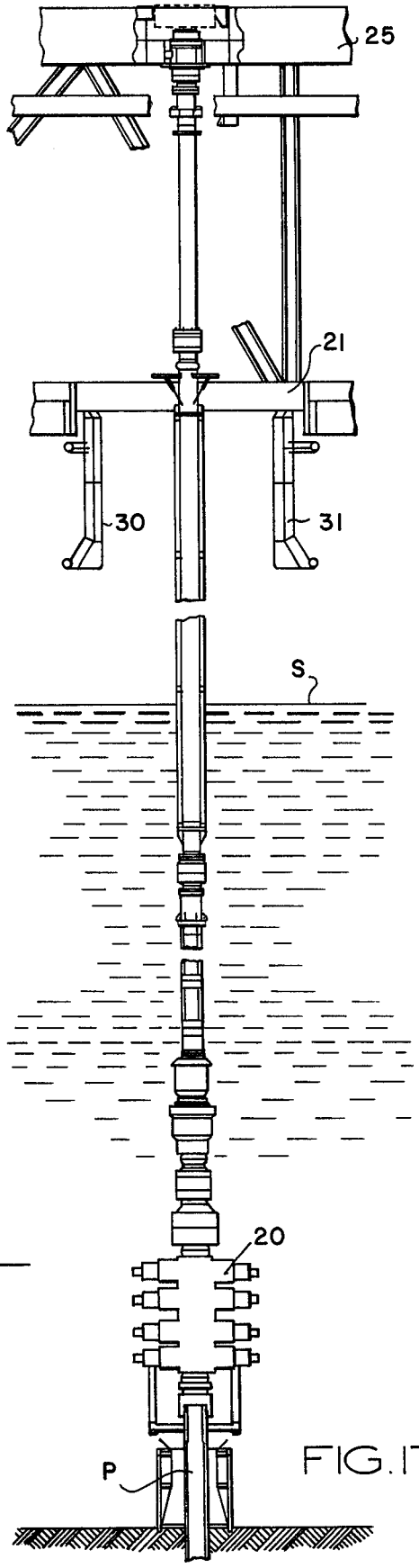

For the sake of completeness, FIG. 16 illustrates the completion of running of the BOP stack to where it is mounted on well head structure P.

Thus, as is evident from the above description and by reference to the drawings that in use of the present invention, each individual secton of a multi-section BOP stack, and the stack itself when joined, are maintained under adequate constraint against substantial lateral movement due to motion of the vessel, or to winds and waves, until a substantial portion of the BOP stack is through the splash zone. This ensures that the BOP stack can be handled and run in sea conditions which could otherwise have required the cessation of operation and a delay in the running of the stack.

Also, while the main constraining means of this invention is disclosed as including guide members 30 and 31, these guide members may take many different forms and may be in a greater number than two. Also, the guide well and constraining means could be formed by a caisson extending below platform 21 so that the BOP stack is passed through the caisson under constraint.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A system for handling and substantially continuously constraining a BOP stack as it is lowered from a platform on an offshore drilling vessel into a body of water, comprising:

movable lifting means mounted on said platform for lifting and moving said BOP stack from a storage position on said platform to a position where it is in line to be run from said platform to the sea bottom; and constraining means mounted on said platform for substantially continuously constraining said BOP stack until a substantial portion of said stack is in said body of water and below the splash zone, said constraining means extending downwardly from said platform and terminating above the surface of said body of water a sufficient amount to be above substantial wave action when said vessel is submerged in said body of water at a depth at which BOP running operations are performed, but terminating sufficiently close to the surface of said body of water during such operations to provide constraint against lateral movement of said BOP stack until at least a portion thereof is below said surface.

2. The system of claim 1 wherein said constraining means includes a pair of oppositely disposed guide members extending downwardly from said platform to form a guide well for receipt and guidance of said BOP stack during lowering thereof.

3. The system of claim 2 wherein said BOP stack further includes a plurality of bumpers mounted thereon for guiding cooperation with said guide members during lowering of said BOP stack.

4. The system of claim 3 wherein said bumpers are provided in at least two pairs of opposed bumpers spaced along the length of the BOP stack with one of said pairs of bumpers located adjacent the lower end of said BOP stack, and another pair of said bumpers located adjacent the upper end of said BOP stack, said spaced pairs of bumpers being spaced so that at least a portion of at least one of said pairs is disposed within said guide means as said BOP stack is lowered through said guide means.

5. The system of claim 3 wherein said BOP stack comprises two sections and wherein each of said sections includes at least two bumpers thereon mounted on opposite sides of said section.

6. The system of claim 1 wherein said constraining means includes a plurality of bumpers mounted on said BOP stack.

7. In an offshore drilling vessel including a platform having a well through which sea bottom operations can be performed, the improvement comprising a system for handling and substantially continuously constraining a BOP stack as it is lowered from the platform into a body of water, comprising:

movable lifting means mounted on said platform for lifting and moving said BOP stack from a storage position on said platform to a position over said well where it is in line to be run from said platform to the sea bottom;

guide means extending downwardly from said platform and from about said well to form a guide well for receipt and guidance of said BOP stack during lowering thereof, said guide means extending a sufficient distance below said platform to permit said BOP stack to be so constrained thereby against substantial lateral movement until a substantial portion thereof is below the splash zone of said body of water during normal operations, but not extending so far below said platform to be in the path of substantial wave action of said body of water during such operations;

first means on said platform for securing at least a portion of said BOP stack in a storage position on said platform, and for constraining substantial lateral movement of said at least a portion of said BOP stack as it is moved from said storage position to a position where it is substantially constrained against substantial lateral movement by said lifting means and is in position for movement to said position over said well; and second means on said platform for constraining said BOP stack over said well to permit it to be lowered under constraint against substantial lateral movement from said position over said well into said guide well where it is constrained by said guide means.

8. The vessel of claim 7 further including a retractable means mounted on said platform and in association with said guide means for supporting the vertical load of said BOP stack in said guide well prior to running it to sea bottom.

9. The vessel of claim 7 wherein said guide means includes a pair of oppositely disposed guide members extending downwardly from said platform to form a guide well for receipt and guidance of said BOP stack during lowering thereof.

10. The vessel of claim 7 including a BOP stack mounted thereon which includes a plurality of bumpers mounted thereon for guiding cooperation with said guide members during lowering of said BOP stack.

11. The vessel of claim 10 wherein said bumpers are provided in at least two pairs of opposed bumpers spaced along the length of the BOP stack with one of said pairs of bumpers located adjacent the lower end of said BOP stack, and another pair of said bumpers located adjacent the upper end of said BOP stack, said spaced pairs of bumpers being spaced so that at least a portion of at least one of said pairs is disposed within said guide means as said BOP stack is lowered through said guide means.

12. The vessel of claim 11 wherein said movable lifting means comprises a bridge crane.

13. The vessel of claim 12 wherein said first means includes at least two upstanding guide rods which engage corresponding guide tubes on said BOP stack portion until said portion is in substantial abutment with said lifting means.

14. The vessel of claim 13 where said second means comprises at least one movable carriage supporting a guide line extending from said platform to a sea bottom structure on which said BOP stack is to be landed.

15. The vessel of claim 14 further including a retractable means mounted on said platform and in association with said guide means for supporting the vertical load of said BOP stack in said guide well prior to running it to sea bottom.

16. The vessel of claim 10 wherein said BOP stack comprises two sections and wherein each of said sections includes at least two bumpers thereon mounted on opposite sides of said section.

17. The vessel of claim 7 wherein said movable lifting means comprises a bridge crane.

18. The vessel of claim 7 wherein said first means includes at least two upstanding guide rods which engage corresponding guide tubes on said BOP stack portion until said portion is substantially constrained by said lifting means.

19. The vessel of claim 7 wherein said second means comprises at least one movable carriage supporting a guide line extending from said platform to a sea bottom structure on which said BOP stack is to be landed.

20. A system for handling and substantially continuously constraining a Bop stack as it is lowered from a platform on an offshore drilling vessel into a body of water, comprising:

movable lifting means mounted on said platform for lifting and moving said BOP stack from a storage position on said platform to a position where it is in line to be run from said platform to the sea bottom;

constraining means mounted on said platform for substantially continuously constraining said BOP stack until a substantial portion of said stack is in said body of water and below the splash zone, said constraining means extending downwardly from said platform and terminating above the surface of said body of water a sufficient amount to be above substantial wave action when said vessel is submerged in said body of water at a depth at which BOP running operations are performed, but terminating sufficiently close to the surface of said body of water during such operations to provide constraint against lateral movement of said BOP stack until at least a portion thereof is below said surface, and means mounted on said platform for securing said BOP stack thereto and constraining substantial lateral movement of said BOP stack until constrained against substantial lateral movement by said lifting means.

21. The system of claim 20 further including means for guiding and constraining said BOP stack against substantial lateral movement as it is lowered from said lifting means into said constraining means.

22. The system of claim 20 wherein said constraining means includes a pair of oppositely disposed guide members extending downwardly from said platform to form a guide well for receipt and guidance of said BOP stack during lowering thereof.

23. The system of claim 22 wherein said BOP stack further includes a plurality of bumpers mounted thereon for guiding cooperation with said guide members during lowering of said BOP stack.

24. The system of claim 23 wherein said bumpers are provided in at least two pairs of opposed bumpers spaced along the length of the BOP stack with one of said pairs of bumpers located adjacent the lower end of said BOP stack, and another pair of said bumpers located adjacent the upper end of said BOP stack.

25. The system of claim 23 wherein said BOP stack comprises two sections and wherein each of said sections includes at least two bumpers thereon mounted on opposite sides of said section.

26. The system of claim 20 wherein said constraining means includes a plurality of bumpers mounted on said BOP stack.

* * * * *

UNITED STATES PATENT AND TRADEMARK OFFICE

CERTIFICATE OF CORRECTION

PATENT NO. : 4,108,318

DATED : August 22, 1978

INVENTOR(S) : Walter F. Rode; Bill R. Jones

It is certified that error appears in the above-identified patent and that said Letters Patent are hereby corrected as shown below:

Column 2, line 54, "maind" should be —main—.

Column 4, line 39, "1" should be —41—.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*